US010287762B2

(12) United States Patent
Stein et al.

(10) Patent No.: US 10,287,762 B2
(45) Date of Patent: May 14, 2019

(54) SANITARY OUTLET ARMATURE

(75) Inventors: Alexander Stein, Ihringen (DE); Oliver Denzler, Bottmingen (CH)

(73) Assignee: NEOPERL GMBH, Mullheim (DE)

( * ) Notice: Subject to any disclaimer, the term of this patent is extended or adjusted under 35 U.S.C. 154(b) by 1660 days.

(21) Appl. No.: 13/702,520

(22) PCT Filed: Apr. 11, 2011

(86) PCT No.: PCT/EP2011/001780

§ 371 (c)(1),
(2), (4) Date: Dec. 6, 2012

(87) PCT Pub. No.: WO2011/154069

PCT Pub. Date: Dec. 15, 2011

(65) Prior Publication Data

US 2013/0082123 A1 Apr. 4, 2013

(30) Foreign Application Priority Data

Jun. 12, 2010 (DE) ..... 20 2010 009 022 U

(51) Int. Cl.
*E03C 1/084* (2006.01)
*E03C 1/086* (2006.01)

(52) U.S. Cl.
CPC ..... *E03C 1/086* (2013.01); *E03C 1/084* (2013.01)

(58) Field of Classification Search
CPC ..... E03C 1/086; E03C 1/084
USPC ..... 239/428.5, 589, 600
See application file for complete search history.

(56) References Cited

U.S. PATENT DOCUMENTS

| | | | | |
|---|---|---|---|---|
| 3,130,915 | A * | 4/1964 | Aghnides | 239/427 |
| 7,677,473 | B2 * | 3/2010 | Kao | 239/428.5 |
| 2006/0163386 | A1 * | 7/2006 | Weis et al. | 239/428.5 |
| 2008/0111007 | A1 * | 5/2008 | Grether | 239/428.5 |
| 2008/0149743 | A1 | 6/2008 | Weis et al. | |
| 2011/0006132 | A1 | 1/2011 | Grether | |

FOREIGN PATENT DOCUMENTS

| | | | |
|---|---|---|---|
| DE | 102006025302 | B3 | 11/2007 |
| WO | 2004038112 | A1 | 5/2004 |
| WO | 2009052961 | A1 | 4/2009 |

* cited by examiner

*Primary Examiner* — Jason J Boeckmann
(74) *Attorney, Agent, or Firm* — Volpe and Koenig, P.C.

(57) ABSTRACT

A sanitary outlet armature having a water outlet with an outlet opening bounded by an inner circumferential wall of the outlet armature, at which inner circumferential wall an internal thread or similar receptacle is provided, in which a sleeve-shaped outlet orifice having an external thread or similar mating receptacle can be threaded in or attached, an insert cartridge being inserted and/or threaded into the outlet orifice, said cartridge including a jet regulator. The outlet orifice supports at least one sealing ring on the circumferential wall thereof, this ring radially or axially sealing between the outer circumferential wall of the outlet orifice and the inner circumferential wall of the outlet armature. The outlet armature allows a reduced production effort and easier maintenance, without sacrificing functionality and seal tightness in the area of the outlet opening.

12 Claims, 6 Drawing Sheets

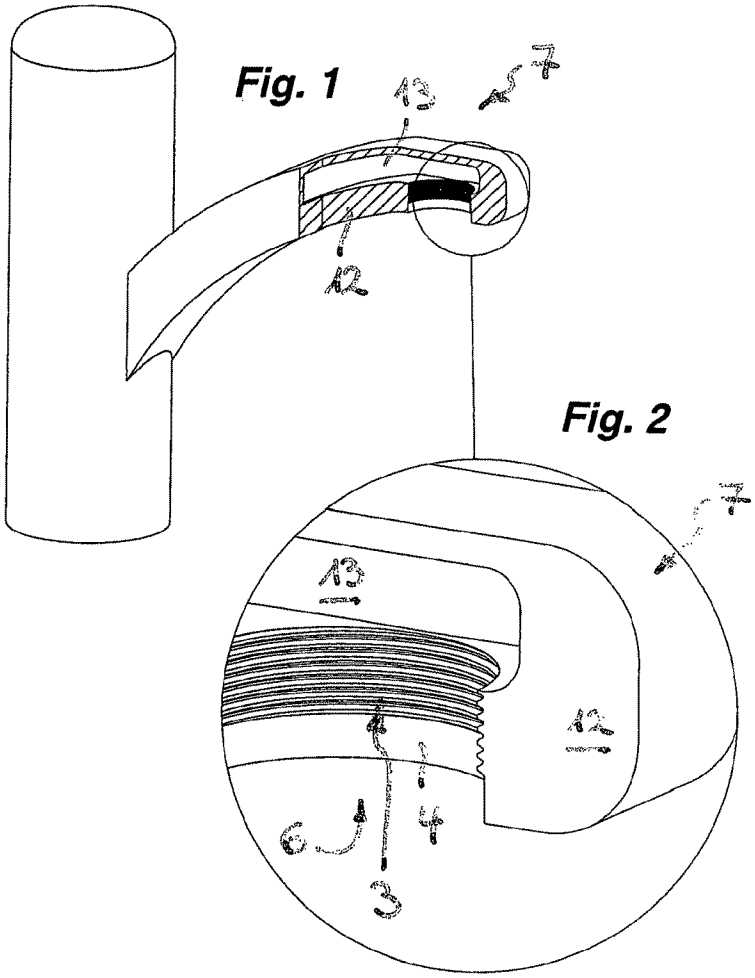
Fig. 1
Fig. 2
7
13
12
11
4
3
6
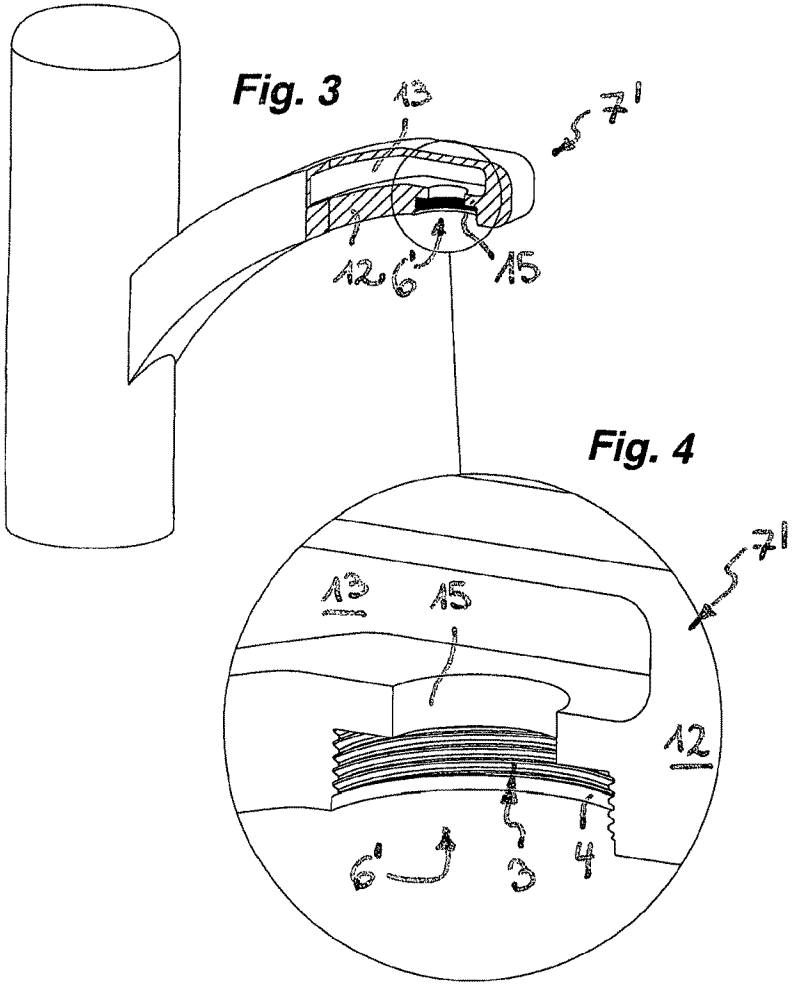
Fig. 3
Fig. 4
7'
13
15
12
9
4
6'

SANITARY OUTLET ARMATURE

BACKGROUND

The invention relates to a sanitary outlet armature having a water outlet, which has an outlet opening defined by an inner circumferential wall of the outlet armature, an inner thread being provided on said inner circumferential wall, having a sleeve-shaped outlet orifice, which can be screwed or fastened into the receptacle by means of an outer thread, and having an insert cartridge, which can be inserted and/or screwed into the outlet orifice, said insert cartridge having a jet regulator, wherein the outlet orifice carries on its circumferential wall at least one ring seal, which, in the functional position, radially and/or axially seals between the outer circumferential wall of the outlet orifice and the inner circumferential wall of the outlet armature.

An outlet armature of the type mentioned in the introduction is already known from FIG. 1 of WO 2004/038112 A1, said outlet armature having a water outlet, which has an outlet opening defined by an inner circumferential wall of the outlet armature, wherein this outlet opening is provided in the outer circumference of an armature body and discharges into a water-guiding inner cavity in the outlet armature, are already known. So as to generate a homogeneous, non-splashing and possibly also softly effervescent water jet, an insert cartridge is inserted into the outlet opening of the previously known outlet armatures and has a jet regulator. On the outer circumference of its cartridge housing, this insert cartridge has an outer thread, which can be screwed into an inner thread on the inner circumferential wall of the outlet armature defining the outlet opening.

So as to delimit the screw-in path and so as to seal the region between the insert cartridge and the inner circumferential wall defining the outlet opening, an annular shoulder or annular flange referred to as a jet regulator bridge is provided in the portion of the outlet opening on the inflow side, facing the inner cavity.

The outlet opening and the annular shoulder or annular flange provided therein are worked by machining into the armature body of the outlet armature. Since, in particular in the region of material accumulations in the armature body where inclusions of air and foreign bodies cannot be ruled out completely, flaws may form during the machining of the armature body, which are disadvantageous on the visible surfaces of the outlet armature or in the sealing regions. In addition, the manufacturing of the armature body and the production of the different clear opening cross sections of the outlet opening in some regions require a considerable production effort. If an outer thread, with which the insert cartridge can be screwed directly into the inner thread provided on the inner circumferential wall defining the outlet opening, is provided on the cartridge housing of the insert cartridge, and if the insert cartridge can be screwed over its entire longitudinal extension into the outlet opening of the water outlet, it is often not obviously clear to the user whether, and how, the outlet armature can be serviced or repaired in this region. In addition, the removal of an insert cartridge located completely in the outlet opening may also prove difficult for a person skilled in the art, without a suitable special tool.

An outlet armature that has a water outlet with a substantially constant clear cross section has therefore already been produced (see WO 2009/052961 A1). The previously known outlet armature has an inner thread on the inner circumferential side in the region of its water outlet, it being possible to screw into said inner thread an insert cartridge having an outer thread provided on the outer circumferential side, in such a way that the outlet end face of the insert cartridge terminates practically flush with the end edge of the outlet armature on the outlet side. In the case of this previously known outlet armature too, it is often not obviously clear to the user whether, and how, the outlet armature is to be serviced, in particular without a suitable special tool.

A jet regulator having a jet regulator housing in which further fixtures are located has also already been produced (see DE 10 2006 025 302 B3). The jet regulator housing can be inserted into a tubular orifice. The jet regulator housing can be inserted into the orifice of the outlet armature by means of an axial insertion movement and can be locked in the orifice by means of a latching mount. To selectively block and release the latching mount provided between the jet regulator housing and the orifice, a locking element that can be actuated externally without the need for tools is provided. The previously known jet regulator requires a separate, specially designed orifice however, which has to be produced separately from the outlet armature. Due to the separate production of the outlet armature and the orifice, these can only be produced with an optically matching surface with difficulty however.

SUMMARY

In particular, the object is therefore to create a sanitary outlet armature of the type mentioned in the introduction, which reduces the outlay associated with its production and facilitates the servicing of such an outlet armature, without thereby sacrificing functionality and seal tightness of the outlet armature in the region of the outlet opening thereof.

With the outlet armature of the type mentioned in the introduction, the solution to this problem according to the invention in particular lies in the fact that the outlet orifice, in the functional position, protrudes beyond the outlet armature via a partial region on the outflow side, in the fact that at least one tool engagement surface for a rotary tool is provided on the partial region of the outlet orifice protruding beyond the outlet armature in the functional position, and in the fact that the tool engagement surface is formed as a two-sided spanner engagement surface.

The outlet armature according to the invention is assigned a sleeve-shaped outlet orifice, which carries an outer thread or similar mating receptacle on its outer circumferential wall, it being possible to screw or fasten the outlet orifice into an inner thread or similar receptacle by means of said outer thread, said inner thread being provided on the inner circumferential wall of the outlet armature defining the outlet opening of the water outlet. To fasten the outlet orifice to the inner circumferential wall of the outlet armature, a screw connection is preferred, although a bayonet connection or any other suitable fastening type may be also be provided between the outlet orifice and the inner circumference of the valve. Since the outlet orifice protrudes beyond the outlet armature via a partial region on the outflow side, the replaceability of the insert cartridge held in the outlet orifice and the type of manipulations necessary for disassembly of said insert cartridge are clearly indicated. Since at least one tool engagement surface for a rotary tool is provided on the partial region of the outlet orifice protruding beyond the outlet armature, and since the tool engagement surface is formed as a two-sided spanner engagement surface, the handling of the outlet armature according to the invention is additionally considerably facilitated during the assembly and disassembly of the outlet orifice assigned thereto. On its outer circumferential wall, the outlet orifice, into which an insert cartridge having a jet regulator can be inserted, carries at least one ring seal, which radially and/or axially seals between the outer circumferential wall of the outlet orifice and the inner circumferential wall of the outlet armature. Since the outlet orifice is radially and/or axially sealed with respect to the inner circumferential wall of the outlet armature defining the outlet opening, the outlet opening can also be incorporated into the outlet armature with a constant clear inner diameter. Since, with the outlet armature according to the invention, it is therefore possible to dispense with an annular flange or annular shoulder on the inner circumferential wall necessary to provide an axial seal, the outlay associated with the production of the outlet armature according to the invention can be considerably reduced in this region. In this case, the insert cartridge is held with the aid of the outlet orifice in the water outlet of the outlet armature according to the invention, which clearly and comprehensibly indicates the replaceability of the insert cartridge. Since the outlet orifice is axially and/or radially sealed with respect to the outlet armature with the aid of the at least one ring seal, an excessive tightening of the outlet orifice in the outlet opening also is not necessary and should not be feared, as would otherwise, often incorrectly, be considered necessary with these components.

A particular advantage of the outlet armature according to the invention is that it is possible to dispense with the annular shoulder or annular flange necessary to provide an axial seal, and that the outlet opening is also to be incorporated into the armature body with a uniform clear opening cross section over its entire longitudinal extension. In accordance with a preferred embodiment according to the invention, the outlet armature has an armature body, which carries the outlet opening in its outer circumference, and the outlet opening has a constant and/or shoulder-free clear opening cross section, in particular in its end region discharging into an inner cavity of the outlet armature.

So that the ring seal necessary to radially seal the outlet orifice provided in accordance with the invention cannot become lost accidentally during storage and transport, it is expedient if a circumferential groove is provided in the outer circumference of the outlet orifice and a ring seal, preferably produced from resilient material, is held in said groove. If this ring seal is held in a circumferential groove in the outer circumference of the outlet orifice, the ring seal is secured on the outer circumference of the outlet orifice in a precisely positioned manner.

So that the functional unit consisting of the outlet orifice and insert cartridge cannot be lost accidentally, and so that a functional installation of this unit is always insured, it is advantageous if the insert cartridge is held in the outlet orifice so as to be secured on either side in the axial direction. If the insert cartridge is held in a secured manner in the outlet orifice, functional assembly with the outlet orifice is always ensured.

In accordance with one embodiment according to the invention, the insert cartridge can be inserted into the outlet orifice from the inflow side thereof as far as an insertion stop. Since, in this embodiment, the outlet orifice is firstly to be disassembled from the outlet armature, before the insert cartridge having the jet regulator can be removed from the outlet orifice, there is less risk of unwarranted manipulations in this region of the outlet armature in this embodiment.

So as to assemble the insert cartridge in the outlet orifice so as to be secured on either side in the axial direction, it may be advantageous if the insert cartridge is held in the outlet orifice so as to be secured between the insertion stop and a retainer that can be releasably fastened to the inner circumference of the outlet orifice. In this case, the retainer may have a deformable retaining ring on its outer circumference or may be formed as such, said retaining ring engaging in a groove of matching shape in the inner circumference of the outlet orifice.

So as to prevent fault currents in the region between the insert cartridge and the inner circumference of the outlet orifice, it may be advantageous if a ring seal is provided between the insert cartridge and the retainer and seals the region between the insert cartridge and the inner circumference of the outlet orifice.

In accordance with another embodiment according to the invention, the insert cartridge can be inserted into the outlet orifice from the outflow side thereof as far as an insertion stop. In this case, the insertion stop provided on the outlet orifice can be formed as an annular shoulder or annular flange arranged on the inner circumference of the outlet orifice.

In accordance with a preferred and particularly easily producible embodiment according to the invention, the insertion stop designed as an annular flange is arranged in the transverse plane of the outlet orifice on the inflow side. If the insertion stop is arranged in the transverse plane of the outlet orifice on the inflow side thereof, practically the entire sleeve interior of the sleeve-shaped outlet orifice is available for the insert cartridge.

So as to hold the insert cartridge in an axially secured manner in the outlet orifice, it is advantageous if the outlet orifice carries on its inner circumference an inner thread, into which an outer thread provided on the outer circumference of the cartridge housing or of an intermediate retainer can be screwed. If the insert cartridge is held in the sleeve interior of the outlet orifice with the aid of an intermediate retainer, commercial conventional jet regulators or similar insert cartridges may possibly also be used in the intermediate retainer in the sanitary outlet armature.

In accordance with a particularly simple embodiment, which can be produced at low outlay, according to the invention, a ring seal is provided between the insert cartridge and the insertion stop and axially seals the region between the insert cartridge and the inner circumference of the outlet orifice.

It is also possible, however, to provide at least one ring seal on the cartridge housing of the insert cartridge, said ring seal(s) radially and/or axially sealing the region between the insert cartridge and the inner circumference of the outlet orifice.

BRIEF DESCRIPTION OF THE DRAWINGS

Developments according to the invention will emerge from the claims as well as the description in conjunction with the drawings. The invention will be described in greater detail hereinafter on the basis of preferred exemplary embodiments.

In the drawing:

FIG. 1 shows an outlet armature according to the invention in longitudinal section in the region of its outlet opening, FIG. 2 shows the outlet armature according to the invention from FIG. 1 in an enlarged longitudinal sectional detail in the region of the outlet opening of its water outlet, FIG. 3 shows an outlet armature, likewise in longitudinal section in the region of its outlet opening, said outlet armature corresponding to the previously known prior art, FIG. 4 shows the outlet armature from FIG. 3 corresponding to the prior art in an enlarged longitudinal sectional detail in the region of its outlet opening.

DETAILED DESCRIPTION OF THE PREFERRED EMBODIMENTS

Figure 7:
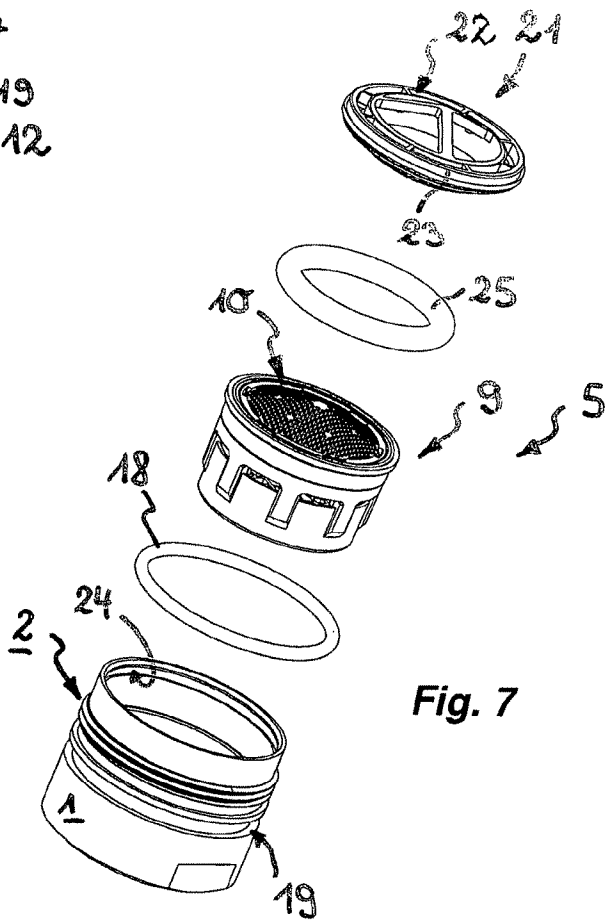
FIG. 7 shows the outlet orifice and the insert cartridge assigned thereto, drawn away from one another and illustrated individually.
Figure 6:
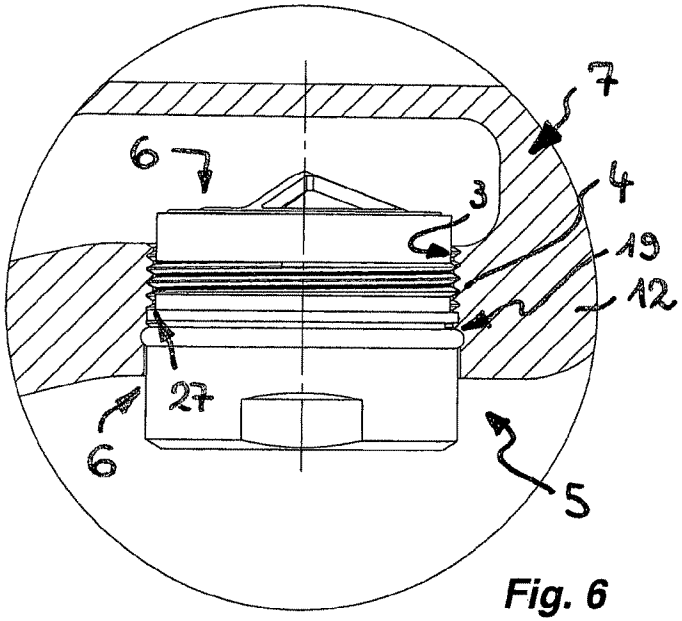
FIG. 6 shows the outlet orifice from FIG. 5 assembled in the outlet opening of an outlet armature.
Figure 5:
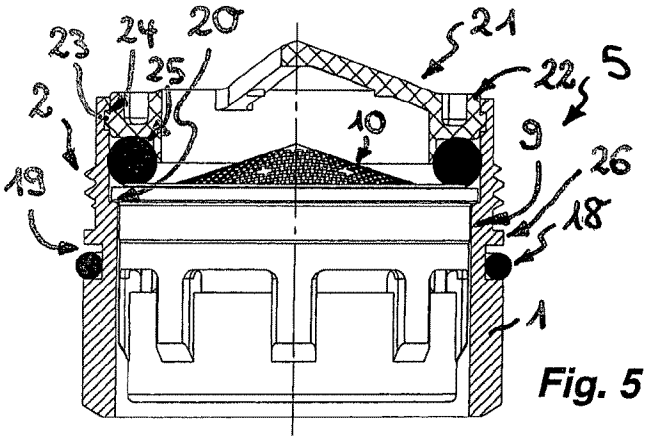
FIG. 5 shows a longitudinal sectional view of a sleeve-shaped outlet orifice, which can be screwed into the outlet opening of a sanitary outlet armature and into which an insert cartridge can be inserted from the inflow side of said outlet orifice as far as an insertion stop and is held in an axially secured manner between the insertion stop and a retainer.
Figure 10:
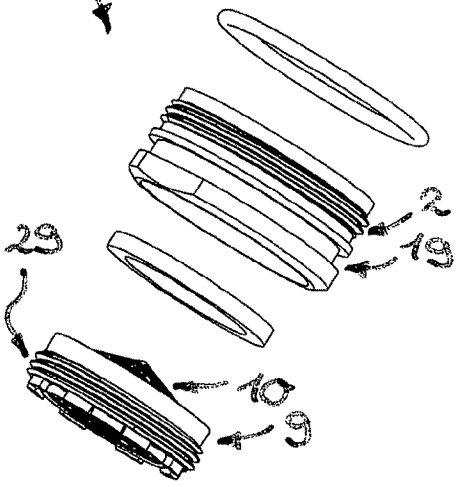
FIG. 10 shows the outlet orifice and the insert cartridge assigned thereto from FIGS. 8 and 9, drawn apart from one another and illustrated individually.
Figure 9:
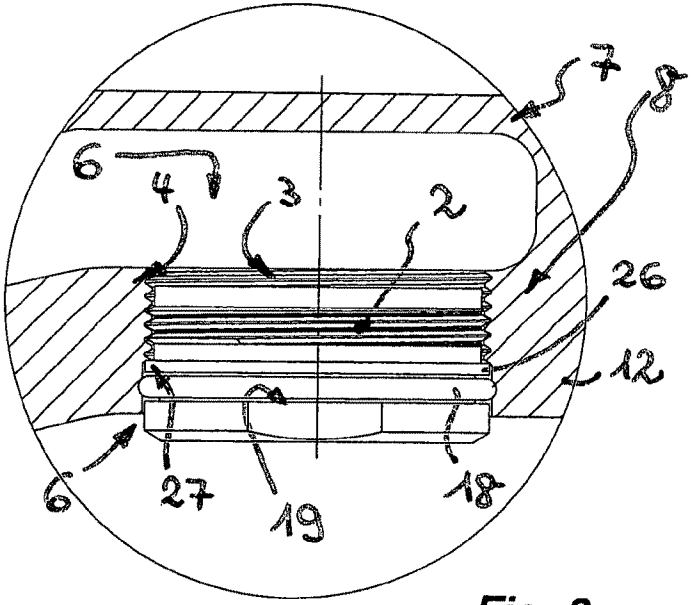
FIG. 9 shows the outlet orifice from FIG. 8 installed on a water outlet, shown in longitudinal section, of a sanitary outlet armature.
Figure 8:
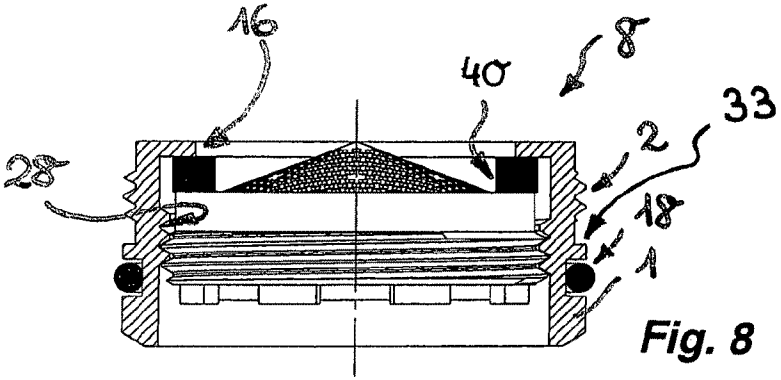
FIG. 8 shows a longitudinal sectional view of a sleeve-shaped outlet orifice, which can be screwed into the outlet opening of an outlet armature and which carries in its sleeve interior an insert cartridge, which has on the outer circumference of its cartridge housing an outer thread, with which the insert cartridge can be screwed from the outflow side of the outlet orifice into an inner thread provided on the inner circumferential wall of the outlet orifice.
Figure 13:
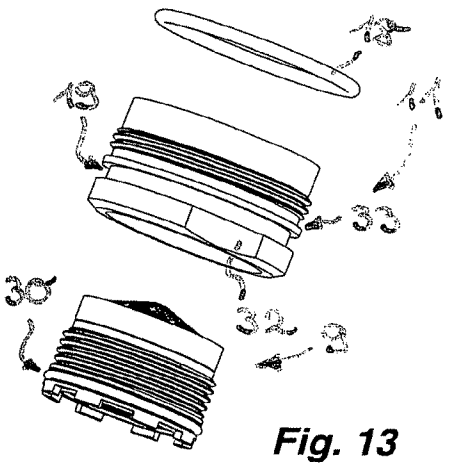
FIG. 13 shows the outlet orifice and the insert cartridge assigned thereto from FIGS. 11 and 12, drawn apart from one another and illustrated individually.
Figure 12:
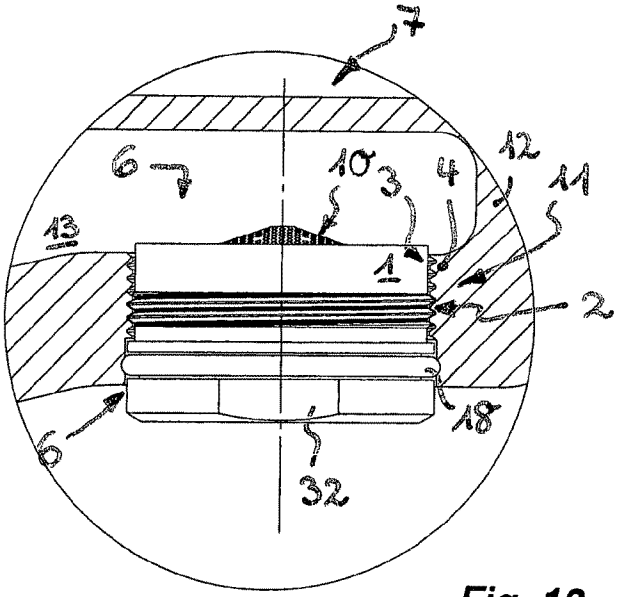
FIG. 12 shows the outlet orifice from FIG. 11 installed on a water outlet, shown in longitudinal section, of a sanitary outlet armature.

Differently designed outlet orifices 5, 8, 11, 14, 17 are illustrated in FIGS. 5 to 19. The outlet orifices 5, 8, 11, 14, 17 are sleeve-shaped and have an outer thread 2 on their outer circumferential wall 1. The outlet orifices 5, 8, 11, 14, 17 can be screwed via their outer thread 2 into an inner thread 3. The inner thread 3 is provided on an inner circumferential wall 4, which defines the outlet opening 6 of the water outlet of a sanitary outlet armature 7.

So as to form a homogeneous, non-splash and possibly also softly effervescent, that is to say aerated, water jet, an insert cartridge 9 can be inserted and/or screwed into the sleeve interior of the sleeve-shaped outlet orifice 5, 8, 11, 14, 17 and has a jet regulator and, where necessary, also a sieve attachment 10 on the inflow side and/or a flow rate regulator possibly arranged therebetween.

The outlet armature 7 provided for the outlet orifices 5, 8, 11, 14, 17 according to FIGS. 5 to 19 is illustrated in greater detail in FIGS. 1 and 2. It is clear from FIGS. 1 and 2 that the outlet armature 7 has an armature body 12, which carries the outlet opening 6 in its outer circumference. Whereas the previously known outlet armatures 7' corresponding to the prior art and illustrated in FIGS. 3 and 4 previously had an outlet opening 6', which has an annular shoulder or annular flange 15 referred to as a jet regulator bridge in its portion of the outlet opening 6' facing a water-guiding inner cavity 13 on the inflow side, the outlet armature 7 intended for the outlet orifices 5, 8, 11, 14, 17 has an outlet opening 6, which has a constant and shoulder-free clear opening cross section in its end region discharging into the inner cavity 13 of the outlet armature 7.

It is clear from a comparison of the outlet orifices 5, 8, 11, 14, 17 illustrated in FIGS. 5 to 19 that these outlet orifices carry on their outer circumferential wall 1 a ring seal 18, which radially and/or axially seals between the outer circumferential wall 1 and the inner circumferential wall 4 of the outlet armature 7.

The sleeve-shaped outlet orifices 5, 8, 11, 14, 17 are assigned to the outlet armature 7. The outlet orifices 5, 8, 11, 14, 17 have on their outer circumferential wall 1 the outer thread 2, with which the outlet orifices 5, 8, 11, 14, 17 can be screwed into the inner thread 3, which is provided on the inner circumferential wall 4 of the outlet armature 7 defining the outlet opening 6 of the water outlet. The outlet orifices 5, 8, 11, 14, 17, into each of which an insert cartridge 9 having a jet regulator can be inserted, carry on their outer circumferential wall 1 at least one ring seal 18, which radially and/or axially seals between the outer circumferential wall 1 of the outlet orifices 5, 8, 11, 14, 17 and the inner circumferential wall 4 of the outlet armature 7. Since the outlet orifices 5, 8, 11, 14, 17 are radially and/or axially sealed with respect to the inner circumferential wall 4 of the outlet armature 7 defining the outlet opening 6, the outlet opening 6 can also be incorporated into the outlet armature 7 with a constant clear inner diameter. Since, with the outlet armature 7 it is thus possible to dispense with an annular flange or annular shoulder on the inner circumferential wall 4 necessary to provide an axial seal, the outlay associated with the production of the outlet armature 7 is considerably reduced. In this case, the insert cartridge 9 is held with the aid of one of the outlet orifices 5, 8, 11, 14, 17 in the water outlet of the outlet armature 7, which clearly and comprehensibly indicates the replaceability of this insert cartridge 9. Since the outlet orifices 5, 8, 11, 14, 17 are at least also radially sealed with respect to the outlet armature 7 with the aid of the at least one ring seal 18, an excessive tightening of the outlet orifice in the outlet opening also is not necessary and should not be feared, as would often incorrectly be considered necessary with an axial seal of these components.

In their outer circumference, the outlet orifices shown in FIGS. 5 to 16 have a circumferential groove 19, in which the ring seal 18 produced from resilient material is securely held. The insert cartridge 9 provided in the outlet orifices 5, 8, 11, 14, 17 is held there so as to be secured on either side in the axial direction. In this case, the insert cartridge 9 of the outlet orifice 5 illustrated in FIGS. 5 to 7 can be inserted into the outlet orifice 5 from the inflow side thereof as far as an insertion stop 20, which is formed in this case as an annular shoulder. The insert cartridge 9 of the outlet orifice 5 is held in the outlet orifice 5 so as to be secured between the insertion stop 20 and a retainer 21 that can be fastened releasably to the inner circumference of the outlet orifice 5. On its outer circumference, the retainer 21 has a resiliently deformable retaining ring 22, which engages releasably latchably with at least one latching protrusion 23 in a latching groove 24 in the inner circumferential wall of the outlet orifice 5. A ring seal 25 is provided between the insert cartridge 9 and the retainer 21 and axially seals the region between the insert cartridge 9 and the inner circumference of the outlet orifice 5. It can be seen in FIGS. 6 and 9 that the outlet orifices 5 and 8 can be screwed into the inner thread 3 in the outlet opening 6 until an annular flange 26, defining the groove 19, of the outlet orifice contacts an insertion stop 27 on the inner circumferential wall of the outlet opening 7.

It can be seen in FIGS. 8 to 19 that, on their inner circumference, the outlet orifices 8, 11, 14, 17 carry an inner thread 28, into which an outer thread 29 provided on the outer circumference of the cartridge housing of the insert cartridge 9 can be screwed. In this case, the insert cartridge 9 in the case of the outlet orifices 8, 11, 14, 17 is screwed into the sleeve interior of these outlet orifices 8, 11, 14, 17 from the outflow side.

In the case of the outlet orifices 8, 11, 17, the insert cartridge 9 can be screwed in from the outflow side of these outlet orifices as far as an insertion stop 16. The insertion stop 16 is formed as an annular shoulder or annular flange arranged on the inner circumference of the outlet orifices 8, 11, 17. It can be seen in FIGS. 8, 11 and 17 that the insertion stop 16 designed as an annular flange is arranged in the transverse plane of the outlet orifices 8, 11, 17 on the inflow side. Whereas the annular flange of the outlet orifice 11 merely delimits the screw-in or insertion path, a ring seal 40 is provided between the annular flange of the outlet orifices 8, 17 and axially seals the region between the outer circumference of the outlet orifices 8, 17 and the inner circumferential wall of the outlet orifice 8, 17.

Figure 11:
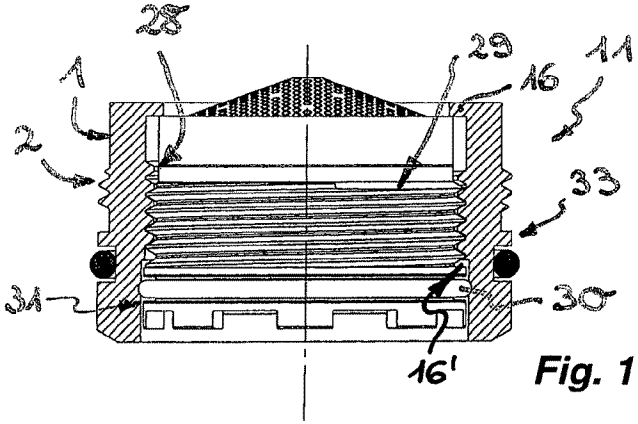
FIG. 11 shows an outlet orifice in longitudinal section, into which, similarly to FIGS. 8 to 10, an insert cartridge can be screwed from the outflow side.
Figure 15:
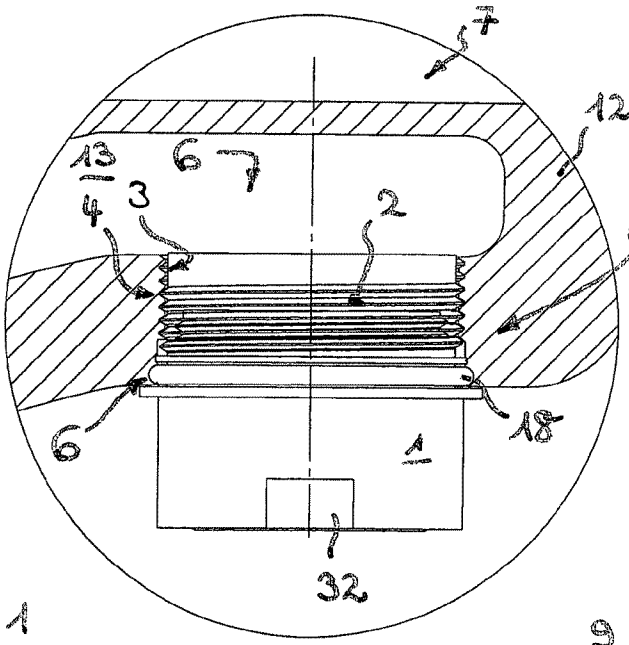
FIG. 15 shows the outlet orifice from FIG. 14 installed on a water outlet, shown in longitudinal section, of a sanitary outlet armature.
Figure 16:
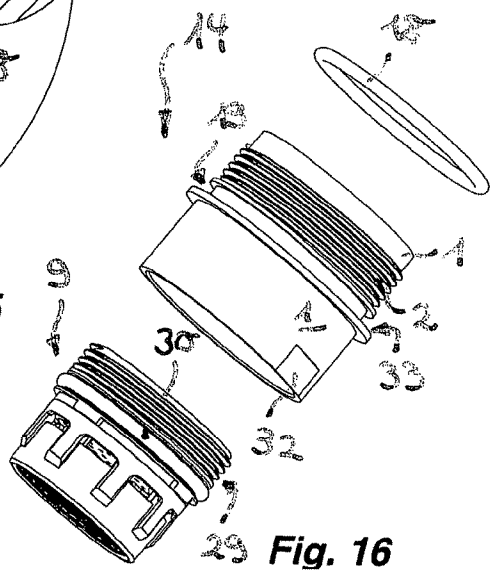
FIG. 16 shows the outlet orifice and the insert cartridge assigned thereto from FIGS. 14 and 15, drawn apart from one another and illustrated individually.
Figure 14:
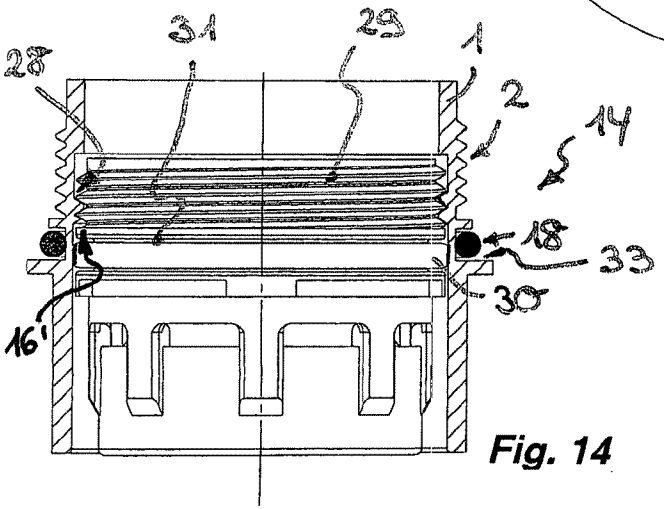
FIG. 14 shows a sleeve-shaped outlet orifice in longitudinal section, which carries in its sleeve interior an insert cartridge, wherein, on the outer circumferential wall of the outlet orifice, an annular flange acting as an insertion stop protrudes laterally, it being possible to screw the outlet orifice into the outlet opening of a sanitary outlet armature as far as said annular flange.
Figure 19:
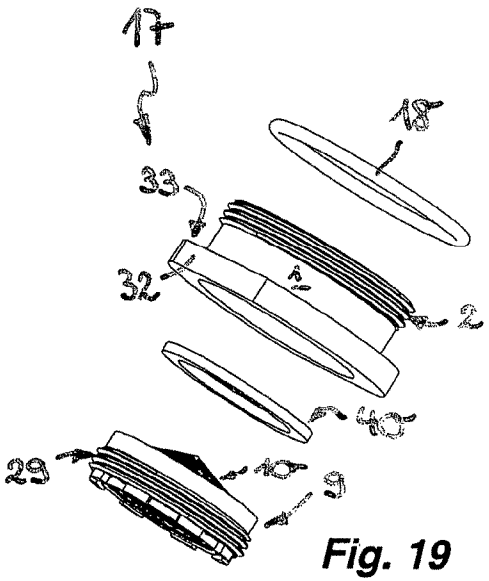
FIG. 19 shows the outlet orifice and the insert cartridge assigned thereto from FIGS. 17 and 18, drawn apart from one another and illustrated individually.
Figure 18:
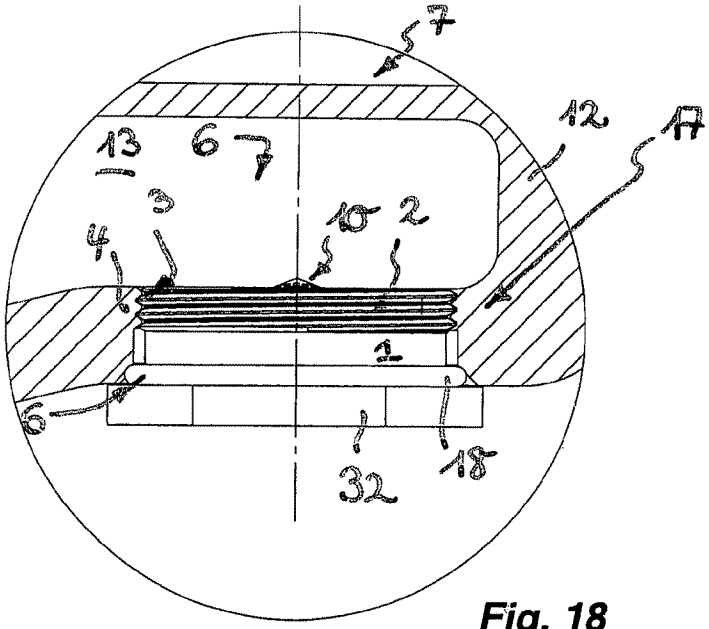
FIG. 18 shows the outlet orifice from FIG. 17 installed on a water outlet, shown in longitudinal section, of a sanitary outlet armature.
Figure 17:
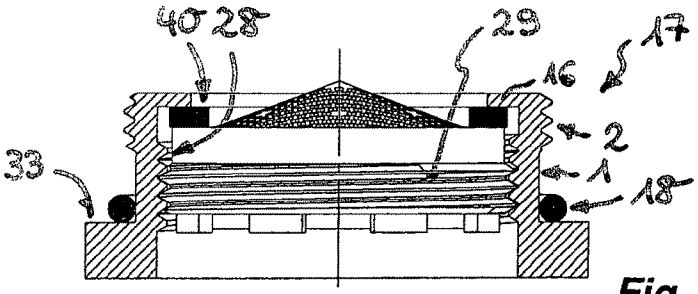
FIG. 17 shows an outlet orifice comparable to FIGS. 14 to 16, with which, however, the annular flange acting as an insertion stop is provided circumferentially on the end-face region of the sleeve-shaped outlet orifice on the outflow side.

If FIGS. 11 and 14 are observed in greater detail, it is clear that an insertion stop 16' may also be provided on the outer circumference of the insert cartridge 9, is formed as an annular shoulder or annular flange, and in this case is arranged upstream of the ring seal 30 in the direction of flow. This insertion stop 16' is preferably arranged downstream of the outer thread 29, adjacent thereto, in the direction of flow.

In the case of the outlet orifices 8, 17, the region between the insert cartridge 9 and the inner circumferential wall of the outlet orifice 8, 17 is axially sealed by means of the ring seal 40, which is fixed between the insertion stop 16 and the end face of the cartridge housing on the inflow side. By contrast, in the case of the outlet orifices 11, 14, this region is radially sealed by means of a ring seal 30, which is held on the outer circumference of the cartridge housing, where it is arranged in a circumferential groove 31.

It can be seen from a comparison of FIGS. 5 to 19 that the outlet orifices 5, 8, 11, 14, 17 protrude beyond the outlet armature 7 via a partial region of their longitudinal extension on the outflow side. In this case, at least one tool engagement surface 32 for a rotary tool is provided on the partial region of the discharge orifices 5, 8, 11, 14, 17 protruding beyond the outlet armature. With the outlet orifices 5, 8, 11, 14, 17, this tool engagement surface 32 is formed as a spanner engagement surface arranged on opposite circumferential sides of the outlet orifice.

On their outer circumference, the outlet orifices 8, 11, 14, 17 have an insertion stop 33, which is designed as an annular flange or annular shoulder and delimits the screw-in path of the outlet orifices 8, 11, 14, 17 into the inner thread 3. The outlet orifices 8, 11, 14, 17 can be screwed into the inner thread 3 of the outlet opening 6, until the insertion stop 33 contacts the outer edge, defining the outlet opening 6, of the outlet armature 7. Whereas, with the outlet armature 14, the ring seal 18 is held in the groove 19, which adjoins the insertion stop 33 on the outflow side, the ring seal 18 with the outlet orifice 17 is merely slid on as far as the insertion stop 33.

In the case of the outlet orifices 14, 17 too, the ring seals 18 seal at least also radially. In this case, the ring seal 18 of the outlet orifice 17 is pressed into a phase, which defines on the outflow side the outlet opening 6 of the outlet armature 7 assigned to the outlet orifice 17, so that a radial and axial sealing effect is produced.

What is claimed is:

1. A sanitary outlet armature (7) comprising a water outlet, which has an outlet opening (6) defined by an inner circumferential wall (4) of the outlet armature (7), an inner thread (3) being provided on said inner circumferential wall (4), a sleeve-shaped outlet orifice (5, 8, 11, 14, 17), which can be screwed or fastened into a receptacle by an outer thread (2), and an insert cartridge (9), which can be at least one of inserted or screwed into the outlet orifice (5, 8, 11, 14, 17), said insert cartridge (9) having a jet regulator, wherein the outlet orifice (5, 8, 11, 14, 17) carries on a circumferential wall thereof at least one ring seal (18), which, in a functional position, at least one of radially or axially seals between an outer circumferential wall (1) of the outlet orifice (5, 8, 11, 14, 17) and the inner circumferential wall (4) of the outlet armature (7), the outlet orifice (5, 8, 11, 14, 17), in the functional position, protrudes beyond the outlet armature via a partial region on an outflow side, at least one tool engagement surface (32) for a rotary tool is provided on the partial region of the outlet orifice (5, 8, 11, 14, 17) protruding beyond the outlet armature (7) in the functional position, and the tool engagement surface is formed as a two-sided spanner engagement surface, wherein the outlet armature (7) has an armature body (12), which carries the outlet opening (6) in an outer circumference thereof, and the outlet opening (6) has at least one of a constant or shoulder-free clear opening cross section, discharging into an inner cavity (13) of the outlet armature (7).

2. The outlet armature as claimed in claim 1, wherein a circumferential groove (19) is provided in an outer circumference of the outlet orifice (5, 8, 11, 14,) and the ring seal (18), is held in said groove.

3. The outlet armature as claimed in claim 1, wherein the insert cartridge (9) is held in the outlet orifice (5, 8, 11, 14, 17), so as to be secured on either side in an axial direction.

4. The outlet armature as claimed in claim 1, wherein the insert cartridge (9) is insertable into the outlet orifice (5) from an inflow side thereof as far as an insertion stop (20).

5. The outlet armature as claimed in claim 4, wherein the insert cartridge (9) is held in the outlet orifice (5) so as to be axially secured between the insertion stop (20) and a retainer (21) that is releasably fastened to an inner circumference of the outlet orifice (5).

6. The outlet armature as claimed in claim 4, wherein a ring seal (25) is provided between the insert cartridge (9) and the retainer (20) and seals a region between the insert cartridge (9) and the inner circumference of the outlet orifice (5).

7. The outlet armature as claimed in claim 1, wherein the insert cartridge (9) can be inserted into the outlet orifice (8, 11, 14, 17) from the outflow side thereof as far as an insertion stop.

8. The outlet armature as claimed in claim 7, wherein the insertion stop (16) is formed as an annular shoulder or annular flange arranged on the inner circumference of the outlet orifice.

9. The outlet armature as claimed in claim 8, wherein the insertion stop (16) designed as an annular flange is arranged in a transverse plane to the outlet orifice (8, 11, 17) on the inflow side.

10. The outlet armature as claimed in claim 1, wherein the outlet orifice (8, 11, 14, 17) carries on an inner circumference thereof an inner thread (28), into which an outer thread (29) provided on an outer circumference of the cartridge housing or of an intermediate retainer can be screwed.

11. The outlet armature as claimed in claim 7, wherein a ring seal (40) is provided between the insert cartridge (9) and the insertion stop (16) and axially seals a region between the insert cartridge (9) and an inner circumference of the outlet orifice (8, 17).

12. The outlet armature as claimed in claim 1, wherein at least one ring seal (30) is provided on the cartridge housing of the insert cartridge (9) and radially seals a region between the insert cartridge (9) and an inner circumference of the outlet orifice (11, 14).

* * * * *